United States Patent [19]

Knaak

[11] 4,200,431

[45] Apr. 29, 1980

[54] ROLLER, PARTICULARLY FOR A ROLLER HEARTH FURNACE

[75] Inventor: Rüdiger Knaak, Neuss, Fed. Rep. of Germany

[73] Assignee: Koppers-Wistra Offenbau GmbH, Dusseldorf-Heerdt, Fed. Rep. of Germany

[21] Appl. No.: 908,248

[22] Filed: May 22, 1978

[30] Foreign Application Priority Data

May 20, 1977 [DE] Fed. Rep. of Germany ..... 2722937

[51] Int. Cl.[2] ..... F27B 9/20

[52] U.S. Cl. ..... 432/236; 432/246

[58] Field of Search ..... 432/246, 236, 249; 193/37

[56] References Cited

U.S. PATENT DOCUMENTS 3,830,625 8/1974 Cable et al. ..... 432/236

4,144,022 3/1979 Fuszo ..... 432/246

*Primary Examiner*—Edward Favors

*Attorney, Agent, or Firm*—Michael J. Striker

[57] ABSTRACT

A roller, particularly for a roller hearth furnace for heating materials to high temperatures, has a supporting body defining a roller axis and having a curved center line and a cross-section substantially normal to said center line. The supporting body includes a plurality of portions which are connected with one another and radially surround the roller axis in spaced relationship therewith. The portions extend in a circumferential direction and are positioned at axially spaced locations relative to one another so that a periphery of the roller is materially formed only at locations corresponding to the axially spaced locations of the portions and the roller has a plurality of empty regions between these locations.

81 Claims, 30 Drawing Figures

FIG. 3
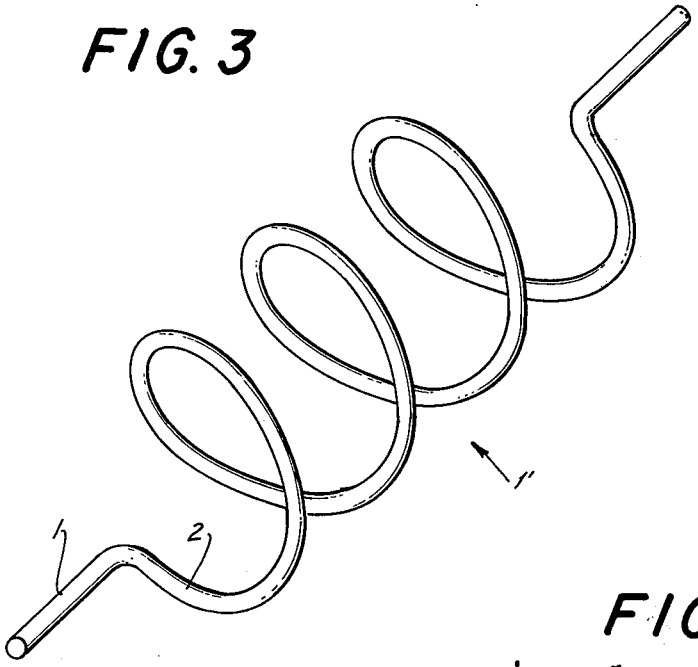
FIG. 6
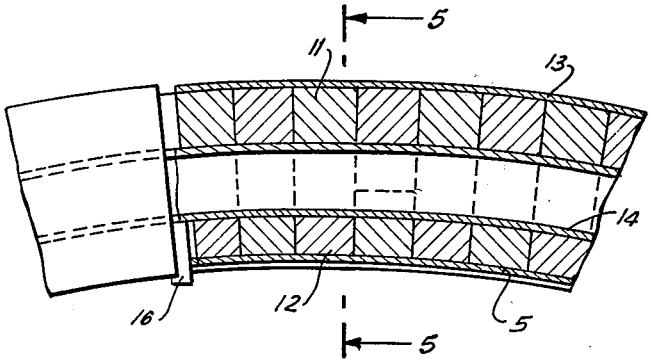
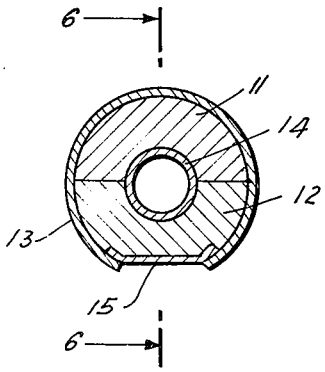
FIG. 5

FIG. 7
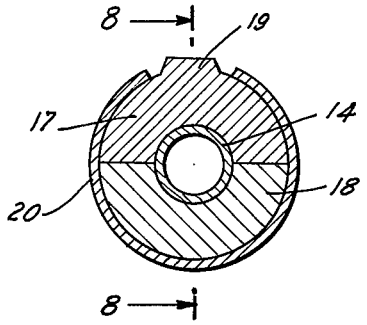
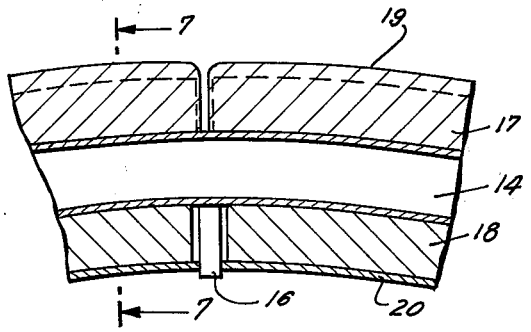
FIG. 8
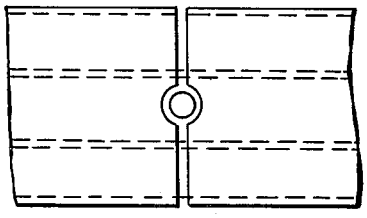
FIG. 9

ROLLER, PARTICULARLY FOR A ROLLER HEARTH FURNACE

BACKGROUND OF THE INVENTION

The present invention relates to a roller for a roller hearth furnace in which the material is to be heated to high temperatures.

It has been known to manufacture the rollers of a ceramic material. Such rollers possess a good temperature resistance. However, for many applications they have the considerable disadvantage that ceramic materials possess only a very limited resistance to sudden changes of temperature. This assumes significance particularly in the cases when the temperature must be rapidly changed in the process of heating. Such an insufficient resistance to sudden changes of temperature is an especial disadvantage in the case when the material has to be rapidly heated, i.e., when higher heat flux densities are necessary. Then a great temperature differential exists, particularly in an inlet of the furnace, between a high temperature of the furnace and a low temperature of the material to be heated. Therefore, the rotating rollers are subjected alternately to higher and lower temperatures. Under such conditions, the ceramic rollers have an insufficient service life.

Moreover, the ceramic rollers also have the disadvantage that the rollers must have a relatively great diameter when the weight resting on them or the width of the furnace is great. This is connected with a relatively great dead weight of the rollers and a relatively low fatigue strength under repeated bending stresses thereof. As a result of a large roller diameter, heating of the workpiece from below is strongly screened or prevented entirely when the diameter of the rollers has to be substantially as large as the distance between the roller axes.

It has been further known to manufacture the rollers of heat-resistant steel or cobalt alloys. Such rollers can be utilized at temperatures up to approximately 1150° C. However, for higher temperatures the strength properties of the metallic alloys are not adequate. It has been further known to cool the metallic rollers by means of a medium flowing therethrough. In this case, supporting parts of the roller which are cold may be screened by surrounding insulating means. However, this construction has a disadvantage in that the cooled heat-adsorbing and heat-conducting surfaces are very large when the diameter of the roller has to be large. The large roller diameters are necessary when the characteristics of the material to be heated do not permit it to rest on small radii of curvature. The large heat-absorbing surfaces require the installation of large heat conductors and increase the heat consumption.

SUMMARY OF THE INVENTION

It is an object of the present invention to provide a roller, particularly for a roller hearth furnace, which avoids the disadvantages of the prior art.

More particularly, it is an object of the present invention to provide a roller, particularly for a roller hearth furnace, which has the advantage of a metallic roller cooled by internal fluid circulation and avoids the disadvantages of such rollers having large diameters.

Another object of the present invention is to provide a roller, particularly for a roller hearth furnace, which has a reduced material expenditure as compared with the conventional rollers.

In keeping with these objects, and with others which will become apparent hereinafter, one feature of the present invention, briefly stated, resides in a roller which has a supporting body defining a roller axis and having a curved center line and a cross-section substantially normal to the center line, wherein the supporting body includes a plurality of portions connected with one another and radially surrounding the roller axis in spaced relationship therewith, which portions extend in a circumferential direction and are positioned at axially spaced locations relative to one another so that a periphery of the roller is materially formed only at locations corresponding to the axially spaced locations of the portions and the roller has a plurality of empty regions between these locations. The cross-section of the supporting body is substantially identical during the entire length thereof. The supporting body further includes a plurality of radially extending portions which are connected with the circumferentially extending portions and each has a length exceeding half of the outer diameter of the roller. The empty regions are bounded between outer lines or narrow outer surfaces of the circumferentially extending portions, and the latter include at least one component extending tangentially to the roller axis.

Such a roller has the advantages of a metallic roller cooled by circulation and at the same time avoids the disadvantages of the rollers having large diameters. Instead of a continuous cylindrical outer surface of the known rollers, the periphery of the roller in accordance with the present invention is formed by a supporting body having a small cross section with a component tangential to the roller axis. With such a conversion of the continuous surface of the cylindrical roller into a supporting body possessing a tangential component, only freely selected portions of the outer cylindrical surface are materially formed. Therefore the surface of the roller which screens the heat radiation of the furnace can be reduced, at a given roller diameter, in the desired way and adapted to the conditions. When the material to be heated has a low weight, the material expenditures for the roller can also be reduced that is particularly significant in the case when expensive highly heat-resistant materials are utilized.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a perspective view showing a roller in accordance with a further embodiment of the present invention;

FIGS. 5 and 6 are views showing sections of insulating means of the roller in accordance with the present invention;

FIGS. 7–9 are views showing insulating means of the roller, in accordance with another embodiment of the invention;

DESCRIPTION OF THE PREFERRED EMBODIMENTS

Figure 1:
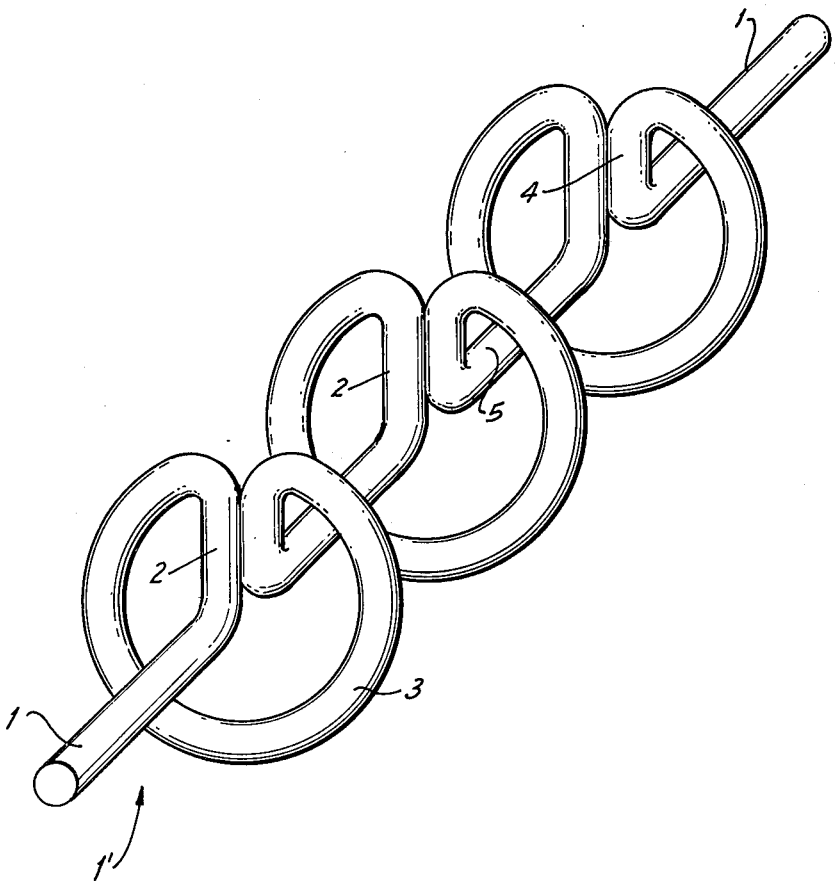
FIG. 1 is a perspective view showing a roller for a roller hearth furnace, in accordance with the present invention.

A roller for a roller hearth furnace is shown in FIG. 1 and is formed by a supporting body which is identified by reference numeral 1'. The supporting body 1' has a curved center line and a cross-section which is substantially normal to the center line. The supporting body 1' has a plurality of portions 3 which are connected with one another and radially surrounds a roller axis in spaced relationship therewith. The portions 3 extend in a circumferential direction and are positioned at axially spaced locations relative to one another so that a periphery of the roller is materially formed only at locations corresponding to the axially spaced locations of the portions 3 and the roller has a plurality of empty regions between these locations.

In such a construction in a roller having a given roller diameter and length the material expenditure is reduced. The rollers can be so arranged in the furnace that their discs interdigitate with one another. This is advantageous for particular applications when an initial portion of a belt has to be transported through the furnace without auxiliary equipment. Even the initial portion of the belt which may hang downwardly will be transported by such a construction at every possible support points in the direction of transportation toward the end of the furnace, when the portions 3 of the adjacent rollers interdigitate with one another.

As shown in FIG. 1, the circumferentially extending portions 3 of the supporting body 1' are substantially toroidal. They are concentric to the roller axis and extend parallel to one another. The supporting body 1' is a continuous body and includes a plurality of groups of portions located in successive order. Each of such groups includes an axial portion 1 extending along the roller axis, a first radial pprtion 2 extending radially outwardly from the axial portion 1, one of the toroidal portions 3 extending circumferentially from the radial portion 2, and a second radial portion 4 extending radially inwardly from the toroidal portion 3. A portion identified by reference numeral 5 is an axial portion of the next following group. The axial portions 1 and 5 form roller axles, whereas the radial portions 2 and 4 form roller spokes.

The roller shown in FIG. 1 may be simply manufactured of one continuous supporting body. Moreover, it has an advantage that the toroidal portions 3 over their entire circumference lie in the same axial locations of the roller. This insures that only movement in a tangential direction is imparted to the material to be heated, even in those cases when the speed of the material is not equal to the circumferential speed of the roller. This means that, even in the case of slippage between the material and the roller the material will not have any tendency to lateral drift.

The supporting body 1' may be constituted by a heat-resistant metal, preferably by molybdenum. Since the roller in accordance with the present invention has a periphery which is materially formed only at axially spaced locations, very high quality and expensive heat resistant materials can be used in this case in a very economical manner. A particular heat-resistant metal can be selected in relation to the temperatures prevailing in the furnace and to the furnace atmosphere. For the furnace having high temperatures above 1150° C. and a reducing particularly hydrogen atmosphere, the supporting body 1' can be constituted by molybdenum with its outstanding mechanical characteristics and good resistance. Such a construction results in only a minimal screening of the material to be heated from the heat radiation and a low heat consumption, inasmuch as the supporting bodies 1' of the rollers do not require to be cooled. A reducing inert gas atmosphere is, however, prerequisite at high temperatures.

Figure 2:
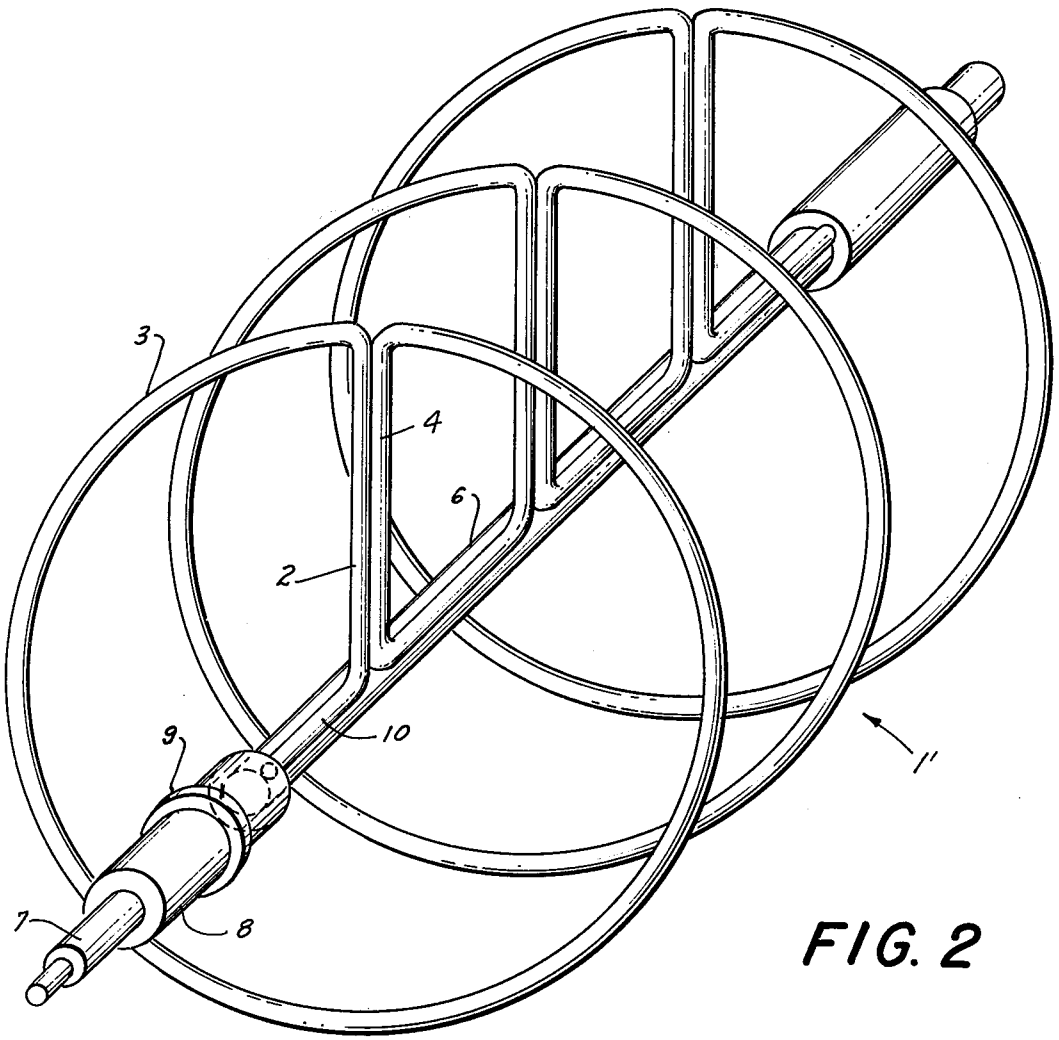
FIG. 2 is a perspective view showing a roller in accordance with another embodiment of the present invention.

As shown in FIG. 2, the roller might have a central tubular member 6 having an inner passage through which a cooling medium can flow. The circumferentially extending portions 3 are mounted on the central tubular member 6. In this case the central tubular member 6 is preferably thicker than the supporting body 1' forming the circumference of the roller. In such a construction the supporting body 1' forming the circumference of the roller can have a relatively small cross-section because it is supported on the central tubular member 6. The latter has an adequate stiffness, even with a relatively small cross-section, because its length at a given roller length is significantly shorter than that of the supporting body 1' forming the circumference of the roller. Thus, this construction has an advantage that the sum of the required cross-sectional areas and therefore also of the surfaces is small, whereby the heat expenditures, the screening, and the material expenditures are reduced.

The roller shown in FIG. 2 has two cooled pivots 7 at its axial ends, which pivots serve to accommodate bearings, drive means, feed means and return means for a cooling medium. Such means are known per se in the art and for this reason are not shown in the drawing. Cylindrical axial parts 8 having a thickness exceeding that of the cooled pivots 7 are provided. The length of the axial parts 8 correspond approximately to a thickness of furnace walls so that the axial parts 8 extend through the latter. Ribs 9 may be provided on the outer surface of the axial parts 8. The central tubular member 6 is connected to the axial parts 8. An initial portion of the central tubular member 6 and an initial portion 10 of the supporting body 1' are displaced relative to an axis of the axial parts 8 and the pivot 7 to opposite directions relative this axis. Fixing means may be provided for securing the initial portions 10, portions 2 and 4 of the supporting body 1' to the central tubular member 6. The connection between the supporting body 10 and the axial part 8, as well as the above-mentioned fixing means can be loosened.

The thicker cylindrical axial part 8 of the roller enables the latter to be moved laterally from the furnace, whereby lateral openings in the furnace wall can be not significantly greater than the diameter of the axial parts 8. For this purpose, the connection between the initial portion 10 of the supporting body 1' and the axial parts 8 must be loosened. The ribs 9 can serve for sealing and reducing the temperature of the furnace wall in the region of the bearings. The laterally displaced position of the initial portion 10 of the supporting body 1' and of the central tubular member 6 relative to the roller axis enables to provide a relatively small diameter of the axial part 8 and an inner passage thereof.

Figure 13:
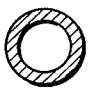
FIG. 13 is a view showing a cross-section of a tubular supporting body forming a roller, wherein the surface of the tubular body is brightly polished.

The supporting body 1' may be formed as a tubular member having an inner passage through which a cooling medium can flow, as shown in FIG. 13. The roller of such a construction has an advantage that it is suitable for utilization at any desired temperature and in all furnace atmospheres. Moreover, expensive materials are not required for manufacture of such a roller. Since the circumference of the roller is materially formed in this case by the tubular member with tangential components and small cross-section, the surface of the roller remains relatively small at a given roller diameter and length.

Heat losses resulting from cooling and screening of the heat radiation are therefore also relatively small.

Figure 4:
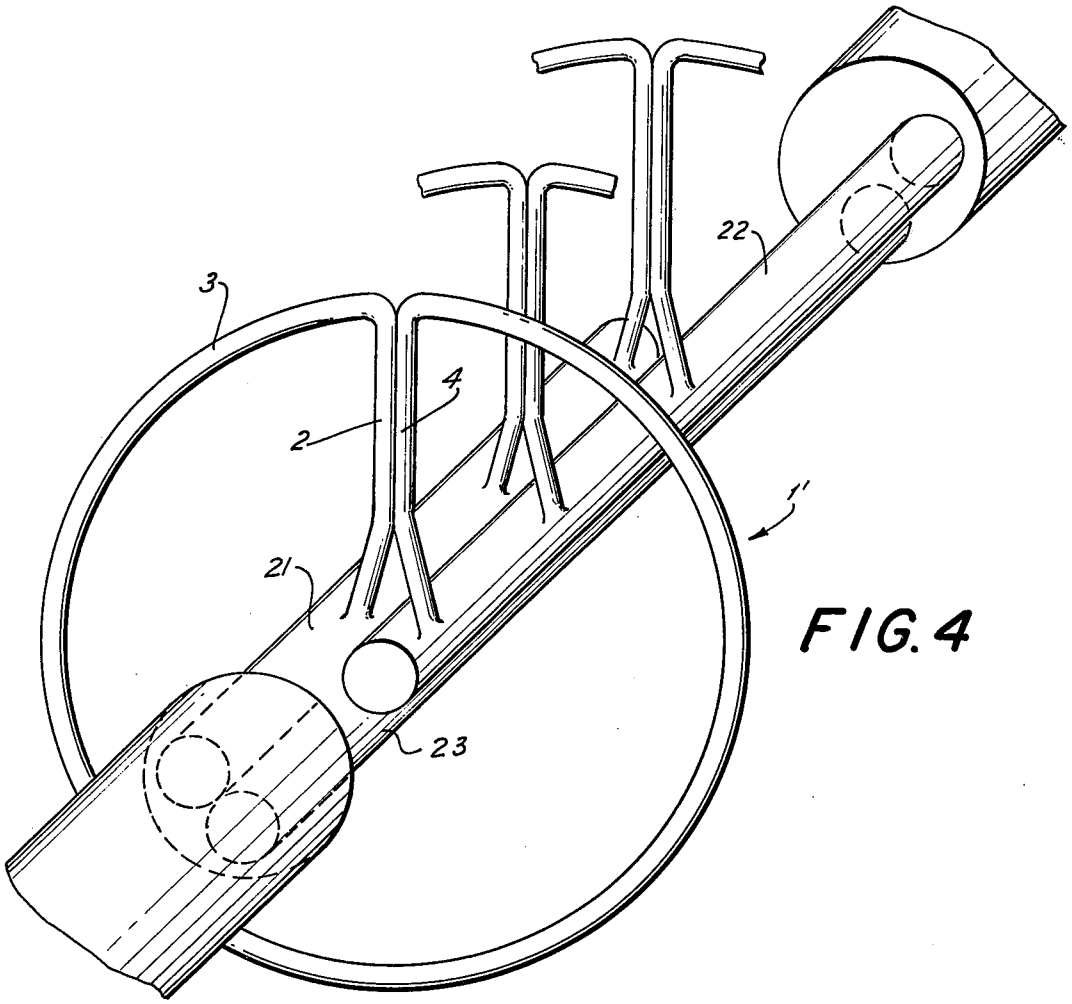
FIG. 4 is a perspective view showing a roller in accordance with a still further embodiment of the present invention.

As shown in FIG. 4 the inner passages of the circumferentially extending toroidal portions 3 communicate with the inner passage of central members supporting these portions. More particularly the inner passages of the portions 3 communicate with a cooling medium feed pipe 21 through the radial spoke-like portion 2 serving as a cooling medium feed conduit. The radial spoke-like portion 4 serves as a cooling medium return conduit, and is connected to a cooling medium return pipe 22, whereby the cooling medium returns to the feed pipe through a further pipe 23. The flow cross-sections of the pipes 21, 22, and 23 are considerably greater than the flow cross-section of the portions 2, 3 and 4 of the supporting body 1'. In such a construction the cooling medium does not flow in succession through the circumferentially extending toroidal portion 8', but, instead, it flows in parallel flows. A further advantage of such a construction is that the pressure differential between the cooling medium feed and return regions can be maintained at a lower level, the heating of the cooling medium is also low, and the quantity of cooling medium rises accordingly at the same time.

It is further proposed to form the supporting body 1' as a helix. Such a construction has an advantage that during rotation of the roller the highest points of the helix forming supporting points for supporting the material to be heated, travel over the entire width of the roller. Also the peripheral area of the roller is reduced to the helix. All the points of material to be heated are supported by the roller in succession. This counteracts both the change as well as the formation of temperature differential, in desired manner.

FIG. 3 shows a preferable construction of such a roller which consists only of a continuous supporting body 1' having, in succession, an axial portion forming the roller axle, a spoke-like portion, a helical portion, and, finally, again the spoke-like portion and the axle portion. In this construction the supporting body, at a given roller diameter, given roller length, and given number of supporting points requires the smallest possible length. This is advantageous with respect to material expenditures and dimensions of the outer surface and, therefore, also with respect to heat consumption and screening. It can be understood from FIG. 3, that the helix has large radii of curvature which is favorable for manufacture thereof, and results in a low flow resistance of the cooling medium.

Figure 27:
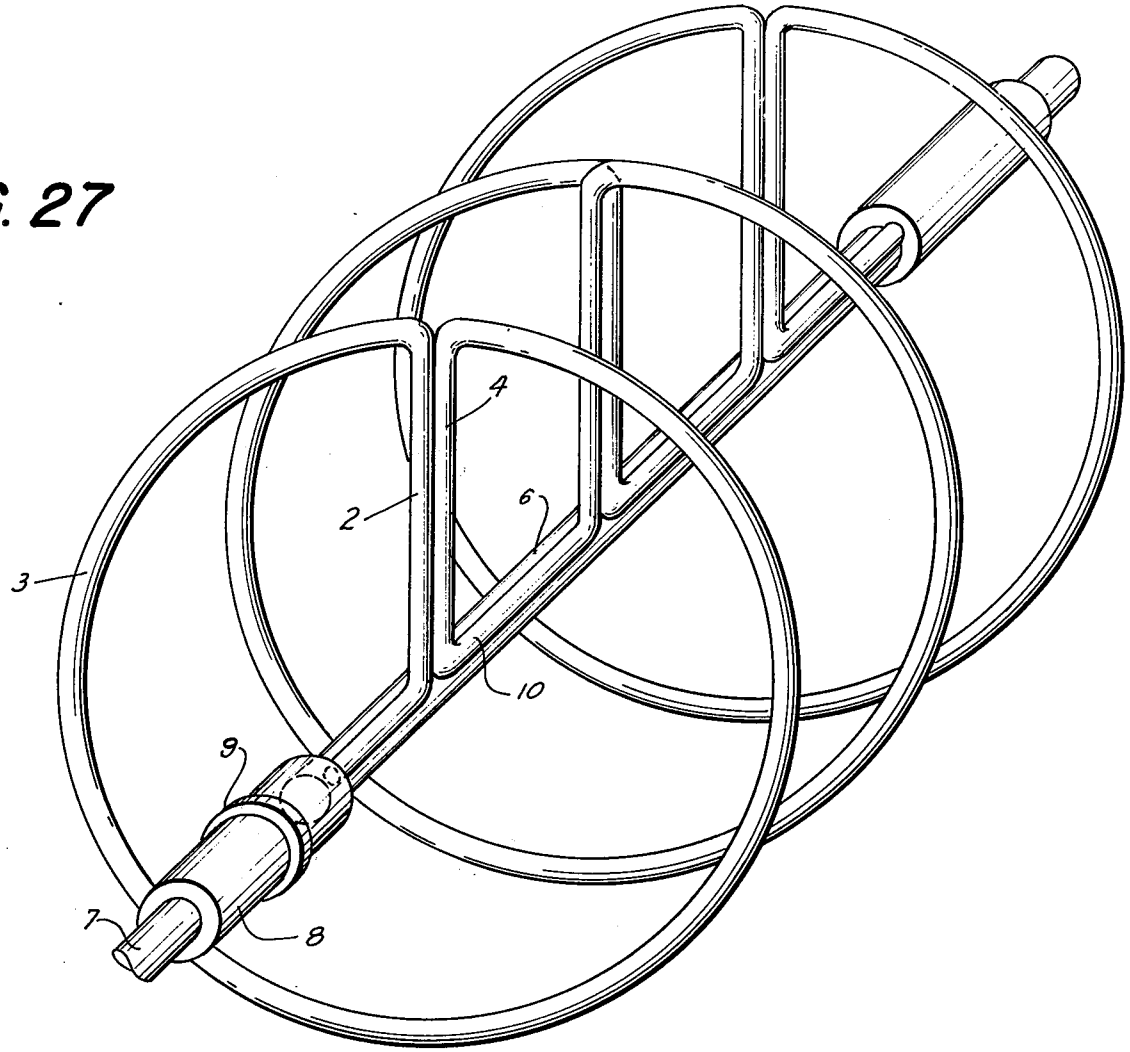
FIG. 27 is a perspective view showing a roller in accordance with an additional embodiment of the present invention.

The supporting body 1' forming the periphery of the roller may have a helix rotating in clockwise direction on the one side of the furnace and a helix rotating in counterclockwise direction on the other side of the furnace. FIG. 27 shows such different rotation for the roller which is not helical. It is to be understood that the helical roller can be formed similarly to the roller shown in this Figure. Such a construction has the advantage that in the case of different belt speeds, on the one hand, and of the roller periphery, on the other hand, a horizontal lateral force acting upon the material as a result of the slippage has opposite directions on both sides of the roller. Thus, these forces cancel each other out whereby any lateral drift of the material is avoided. Moreover, the inclination of the convolutions of the helix on both sides of the roller can be so selected that the supporting points of the material to be heated on the helix on both sides extend to the edges of the material. Therefore, running of the material onto the helix is avoided, and in the case when the material has dropping edges the latter can be pushed laterally away.

Figure 28:
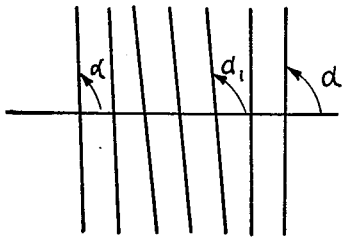
FIGS. 28 and 29 are schematic views showing inclination of the roller's convolutions to the roller's axis in accordance with two different embodiments.
Figure 29:
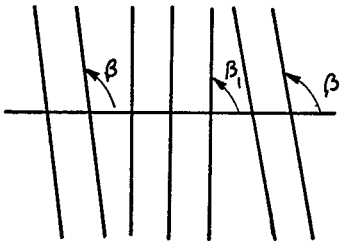

The angle of inclination of the helix along the roller axis may differ. It is particularly proposed that the angle of inclination of the helix convolutions in a central portion of the roller be greater than that in an end portions of the latter, as schematically shown in FIG. 28. In such a construction, when a thin belt-like material is treated in the furnace and operational breakdowns occur at high temperatures, the material cannot drop to a greater extent at its outer edge beyond the supporting points on the helix than between the supporting points in the central portion of the roller. When the roller is so constructed, it may be also advisable that the angle of inclination of the convolutions in the end portions of the roller be greater than that in the central portion of the roller, as schematically shown in FIG. 29. When the direction of convolutions of the helix and the angle of inclination thereof is the same, the distance between the supporting points of the material of the helix remains the same during rotation. However, when the convolutions are oppositely inclined relative to one another, the distance between the supporting points changes during rotation from zero to twice the inclined magnitude. Therefore, in this case the maximum distance between the supporting points in the central portion of the roller is twice as great as in the remaining portions thereof. When the maximum distance between the supporting points in the central portion of the roller should not be significantly greater than that in the remaining portions thereof, the inclination of the convolutions in the central portion of the roller has to be reduced accordingly.

In addition to the helical supporting body, the roller might have a central tubular member similarly to the roller shown in FIG. 2, which central tubular member is preferably thicker than the supporting body. The helical supporting body and the central tubular member may be connected in this case by spoke-like portions. Inasmuch as the central tubular member is short as compared with the helical supporting body, it possesses a substantially higher stiffness and strength. Since the helical supporting body is supported on the central tubular member by means of the spoke-like portions, it can be manufactured appropriately weaker than results in a reduced material expenditure, a reduced surface, and, consequently, reduced heat adsorption and screening.

The tubular supporting body 1' may be provided with means reducing the heat losses. It is particularly proposed that the outer surface of the tubular body which is exposed to the radiation of the furnace be constructed as a bright surface with lower heat radiation-absorption characteristics, in particular as a polished surface of heat-resistant steel, nickel, silver, molybdenum. On the other hand, highly reflective materials may also be applied as coatings on the outer surface of the tubular body constituted by a different base material. Insulating means may surround the tubular body, and in addition, the outer surface of the insulating means or layer which is exposed to the radiation of the furnace, may be also constructed as a bright surface with low heat radiation-absorption characteristics.

When the tubular body has a polished surface of highly reflective material, this reduces the heat absorption at high furnace temperatures to 10% and less of the values obtained in conventional rollers. The temperature of the outer surface of the tubular body can be held so low as a result of the cooling by means of the cooling medium, that the radiation properties do not change under the action of the influence of the heat radiation and the furnace atmosphere. When the insulating means includes metallic parts which heat up appropriately, the permanence of the radiation properties must be insured by means of a protective gas atmosphere and the selection of an appropriate metal. In such construction the heat consumption and the consumption of the cooling medium are considerably reduced.

The insulation of the cooled tubular body is subjected to high loads as a result of the alternating mechanical load as well as of the temperature differentials between furnace area and the material to be heated. In connection with this, it is proposed to form the insulation of one or several layers of an appropriately heat-resistant metal, particularly of layers of a sheet material located one upon another. Experience has shown that such sheets have a low heat conduction and good strength, particularly against thermal shock.

In accordance with the present invention, the high resistance to thermal conduction of ceramic metals and the good resistance against thermal shock of thin sheets can be combined so that the cooled tubular body is insulated by an inner layer of ceramic insulating material and an outer layer of heat-resistant sheet. Such a construction has an advantage that the outer layer of sheet material holds the inner ceramic insulation together, even if it is torn as a result of stress. The inner insulation may consist of perforated discs whose widths is smaller than their outer diameter, the outer sheet cover may consist of sections whose lengths is more than twice as great as their outer diameter. The discs may consist partly of a ceramic material having a great density with a high strength and partly of a ceramic material having a low density, even of a ceramic fiber material, and better insulation properties. This construction takes into account the different elastic properties of metals and ceramics. Furthermore, the different thermal expansions as a result of differing temperatures and material properties is also taken into consideration.

The above mentioned insulating means are shown in the drawing. As particularly shown in FIGS. 5 and 6, the insulating means includes outer ceramic parts 11 and inner ceramic parts 12 which are encased by a sheet cover 13 forming an outer shell. The latter has a continuous cutout having at least the width of the cooled inner tubular body 14 in order to simplify mounting of the roller. A sheet member 15 covers the cutout in the tubular cover 13.

In order to assemble the roller, the insulating parts 11, 12 and 15 are first positioned on a section of the tubular body 14, then the outer shell 13 is pushed over an adjacent uninsulated section of the tubular body 14, and then the outer shell 13 is moved in an axial direction onto the insulating parts 11, 12 and 15. A pin 16 which is firmly connected to the tubular body 14 is provided so as to prevent the displacement of the insulation parts 12 and the sheet member 15. The displacement of the tubular cover section 13 is prevented by spot welding to the sheet member 15. The insulating parts 11 and 12 may be provided with interengaging projection and groove in order to prevent displacement of the outer insulating part 11.

In accordance with a further embodiment shown in FIGS. 7–9, the insulating means may include outer parts 17 and inner parts 18 which are held together by an outer tubular sheet cover 20. The tubular cover 20 is provided with a cutout at an outer side thereof which has at least the width of the inner tubular body 14. The outer insulating part 17 has an extension 19 projecting outwardly beyond the outer cover 20 so as to serve as a supporting surface for the material to be heated. Support of the material to be heated on a ceramic roller surface is desired in several applications, particularly in order to avoid pickling action on sheets. A pin 16 can again prevent lateral displacement of the insulating parts.

In the case when the rollers are utilized in an electric resistance furnace, the supporting body 1' forming the periphery of the roller may be constituted of a heat resistant material and electrically connected with a source of electric current so as to serve as a heating element schematically shown in FIG. 2. The supporting body 1' may be constituted of molybdenum. Current feed lines C electrically connecting the supporting body with the source of electric current may pass through cooled pivots of the central tubular member whose passage is filled with a cooling medium. Such a construction involves low material expenditures and is advantageous in the case when only thin sheets of one or several millimeter thickness are to be transported through the furnace, whereby the mechanical stress of the periphery of the roller remains low. Fixing and connecting elements between the heating element forming the periphery of the roller and the cooled central tubular element are insulated in this case.

When the tubular supporting body is insulated by means of layers of a sheet heat-resistant metal, it is proposed that these be provided with a bright surface with a low radiation absorption characteristic both inside and outside of the same. The heat transfer between the individual layers of a sheet material is substantially determined by the radiation properties of the surfaces thereof, inasmuch as the heat transfer takes place in the region of high temperatures. In such construction, the heat transmission is reduced in a desired manner.

Figure 10:
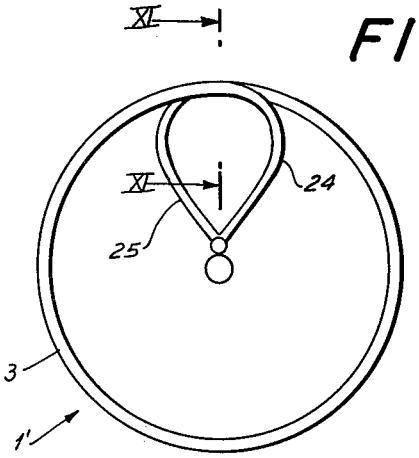
FIGS. 10–12 are views showing a roller including a supporting body which is supported by an outer tube.
Figure 11:
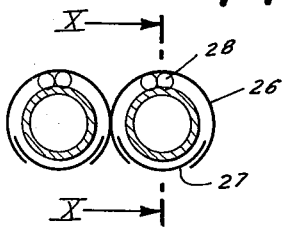
Figure 12:
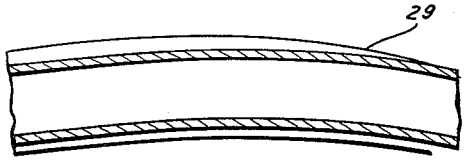

As shown in FIGS. 10–12, the toroidial portion 3 of the supporting body 1' merges into spoke-like portions 24 and 25 with a radius which is larger than one-eighth of the diameter of the roller. Since the radius of curvature is relatively large, the pressure losses in the cooling medium flowing through the supporting body are lowered and local formation of bubbles is avoided. The cooled tubular supporting body is surrounded by a polished metallic outer tube 26 and a similarly polished metallic inner tube 27. Since the ceramic tubular member is supported in the two tubes 26 and 27, the mounting of the roller is very easy. The outer and inner tubes continuously extend over more than 360° C. along the circumference of the cooled tubular body and are connected to the latter at one point in a known manner.

The connection of the tubes at only one point enables them to expand relative to the cooled inner tubular body. In the regions of the roller when the material to be heated is supported on the same, spacer elements may be provided between the outer tube 26 and the cooled inner tubular body. Such spacers may be formed as wires 28 which maintain a clearance between the cooled tubular body and the outer tube 26. End portions 29 of the outer tube 26 have a diameter which is reduced to a smaller outer roller diameter in the region of the support of the material to be heated so as to insure that the material runs smoothly on the outer tube 26.

FIG. 13 shows the cross-section of the tubular body cooled in passage in accordance with the present invention, whose surface is brightly polished.

Figure 14:
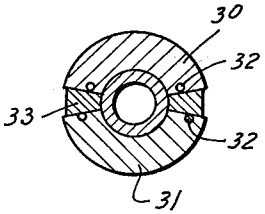
FIG. 14 is a view showing insulating means of the roller in accordance with a further embodiment of the present invention.
Figure 15:
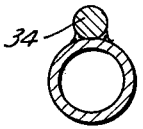
FIGS. 15–26 are views showing a roller in accordance with the present invention, provided with elements which are arranged for supporting a material to be heated.
Figure 16:
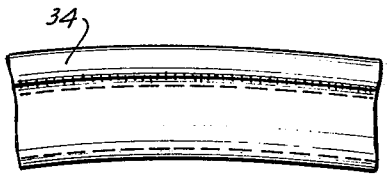

As shown in FIG. 14, the insulating means includes an upper portion 30 of ceramic material and a lower portion 31 also of ceramic material. Both portions are provided with heat-resistant wires 32 forming loops at the sides of the portions which face toward each other. In order to assemble the roller the two portions of ceramic material are positioned on the cooled tubular body and connected to one another by a wire 33 which is pushed through the loops of the wires 32. A gap between the upper portion 30 and the lower portion 31 is then closed by means of a refractory mass. Such a construction is advantageous in that the metallic wire which connects the two portions of insulation and is also subjected to tensile stress is protected from the heat radiation of the surface by the ceramic insulation itself.

Figure 17:
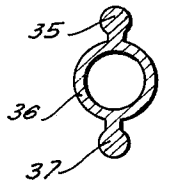
Figure 18:
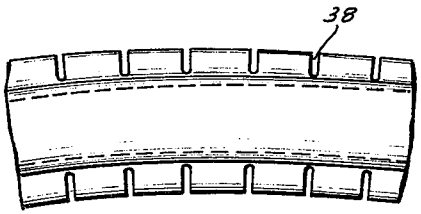
Figure 19:
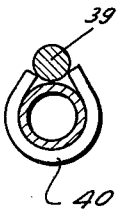
Figure 20:
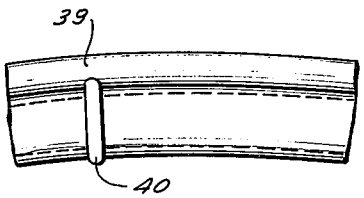

FIGS. 15–18 show an additional supporting element which may be provided in the roller. Such an additional supporting element is identified by reference numeral 34 and may have a round or prismatic cross-section. The supporting element 34 may be connected to the supporting body 1' by means of a weld seam which may be interrupted. In FIGS. 17 and 18 the supporting element is identified by reference numeral 35 and is of one piece with the supporting body 1'. The supporting element 35 is manufactured simultaneously with the manufacture of the supporting body and formed as a projection on the latter.

A neck portion 36 may be provided between the supporting element 35 and the cooled supporting body 1'. The heating of the supporting element 34 in the furnace can be influenced in a desired manner by the selection of the thickness and the length of the weld seam which connects the supporting element 34 to the cooled supporting body 1'. The same is attained by the selection of the ratio of the supporting element 35 to the neck portion 36. In many cases it may be advantageous that the supporting element has the same temperature level as the material to be heated. An additional element 37 which is similar to the elements 34 and 35 may be provided at an inner side of the cooled supporting body at a location opposite to the points of support of the material to be heated. The element 37 may be also round or prismatic. Such a construction is advantageous in that the thermal stresses act symmetrically relative to the center line of the supporting body whereby any deformation of the supporting body under the influence of the heat is avoided. Furthermore, gaps 38 may be provided in the element 34, 35 and 37 so as to enable expansion of these elements relative to the cooled supporting body 1'.

Figure 21:
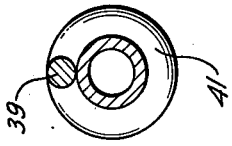
Figure 22:
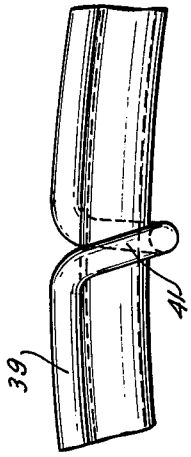

As shown in FIGS. 19–22, the supporting element for supporting the material to be heated may be constituted by a wire 39 arranged on an outer circumference of the cooled supporting body. Loops 40 connects the wire 39 with the supporting body 1'. The wires 39 are not firmly connected to the supporting body in order to enable expansion resulting from heating of the wires. The wires 39 may be connected to the supporting body by means of loops 41 formed by uncoiling and bending the wire itself as shown in FIGS. 21 and 22. In such a construction the wire 39 and the loops 41 together form a continuous wire element. Such construction is advantageous in that the wire 39 which heats up considerably in the furnace can expand freely and no thermal forces are transmitted to the cooled supporting body.

Figure 23:
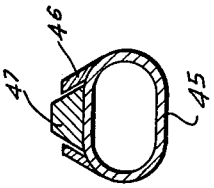
Figure 24:
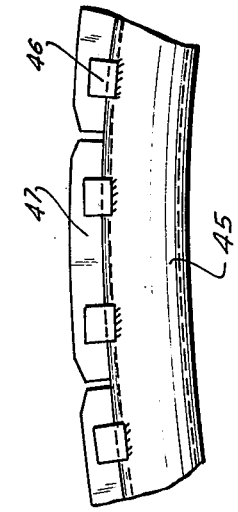
Figure 25:
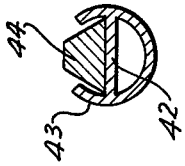
Figure 26:
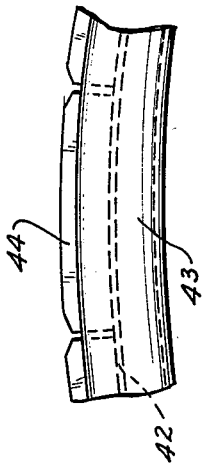

The cooled supporting body may have a round or prismatic cross-section and particularly a flattened round cross-section as shown in FIGS. 23 and 24 and identified by reference numeral 45. Webs 46 are welded to the supporting body 45, as interrupted fins which hold riders 47. The riders 47 have a prismatic cross-section and are manufactured of a heat-resistant material. The cooled supporting body shown in FIGS. 25 and 26 has a partition wall 42 which subdivides the interior of the supporting body into a closed lower portion through which a cooling medium flows, and an open upper portion having two side walls 43. Prismatic riders 44 of a heated resistant material are inserted between the side portions 43 of the thus-formed upper portion of the supporting body.

The construction shown in FIGS. 23–26 is advantageous in that the riders of a heat resistant material can heat up considerably without being subjected to thermal forces acting upon the cooled supporting body 1'.

Figure 30:
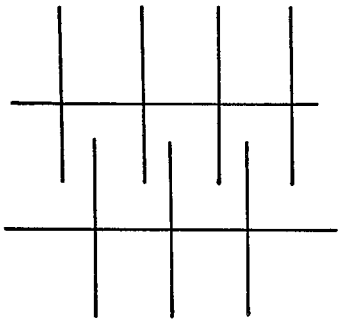
FIG. 30 is a schematic view showing two rollers in accordance with the present invention, located adjacent to one another.

It is further proposed that the rollers having the helical supporting bodies are installed in a roller hearth furnace in such a way that the distance between the roller axis is smaller than the diameter of each of the rollers, as schmatically shown in FIG. 30, and that the rollers are driven in such a way that the angular location of the helixes of all rollers is approximately the same. In such a case, all the rollers should be substantially identical. The convolutions of the helixes of the adjacent rollers interdigitate with one another, but do not come into contact with one another. Such a construction is advantageous in that, even when the rollers have the supporting bodies formed by helixes for the material to be heated, a surface is provided which moves at all points toward the end region of the furnace. In this case, even a sagging initial portion of a belt is transported through the furnace without difficulty.

The means for reducing heat losses of the roller have been described hereinabove as provided in the supporting body 1'. It has to be understood that similar means may be also provided in the central tubular member supporting the curved supporting body 1'.

It will be understood that each of the elements described above, or two or more together, may also find a useful application in other types of constructions differing from the types described above.

While the invention has been illustrated and described as embodied in a roller for a roller hearth furnace, and a roller hearth furnace provided with the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roller, particularly for a roller hearth furnace for heating materials to high temperatures, comprising a supporting body defining a roller axis and having a curved center line and a cross-section substantially normal to said center line, said supporting body including a plurality of portions which are connected with one another and radially surround said roller axis in spaced relationship therewith, said portions extending in a circumferential direction and being positioned at axially spaced locations relative to one another so that a periphery of the roller is materially formed only at locations corresponding to said axially spaced locations of said portions and the roller has a plurality of empty regions between said locations.

2. The roller as defined in claim 1, wherein said cross-section of said body is substantially identical during the entire length thereof.

3. The roller as defined in claim 1, wherein said body further includes a plurality of radially extending portions which are connected with said circumferentially extending portions.

4. The roller as defined in claim 3, wherein circumferentially extending portions of said body have an outer diameter defining the outer diameter of the roller, each of said radially extending portions having a length exceeding half of said outer diameter.

5. The roller defined in claim 1, wherein each of said circumferentially extending portions has an outer line defining a respective one of said locations, said hollow regions being axially bounded between said lines.

6. The roller as defined in claim 1, wherein each of said circumferentially extending portions has a substantially narrow outer surface defining a respective one of said locations, said hollow regions being bounded between said outer surfaces.

7. The roller as defined in claim 1, wherein said circumferentially extending portions include at least one component extending tangentially to said roller axis.

8. The roller as defined in claim 1, wherein said supporting body is constituted by a heat-resistant metal.

9. The roller as defined in claim 8, wherein said heat resistant metal is molybdenum.

10. The roller as defined in claim 1, wherein said supporting body is a curved tubular member having an inner passage.

11. The roller as defined in claim 10; and further including cooling medium accommodated in said inner passage of said curved tubular member.

12. The roller as defined in claim 11; and further including insulating means surrounding said curved tubular member.

13. The roller as defined in claim 11, wherein said curved tubular member has an outer surface adapted to be exposed to radiation while being in a furnace; said outer surface of said curved tubular member being bright and having substantially low heat radiation absorption properties.

14. The roller as defined in claim 12, wherein said insulating means has an outer surface adapted to be exposed to radiation while being in a furnace, said outer surface being bright and having substantially low heat radiation absorption properties.

15. The roller as defined in claim 13, wherein said outer surface is polished.

16. The roller as defined in claim 15, wherein said curved tubular member is constituted by a material selected from the group consisting of heat-resistant steel, nickel, silver and molybdenum.

17. The roller as defined in claim 13, wherein said curved tubular member is coated by a highly-reflective material forming said bright outer surface.

18. The roller as defined in claim 1, wherein said circumferentially extending portions of said body are discs, said empty regions being formed axially between said discs.

19. The roller as defined in claim 11, wherein said circumferentially extending portions of said body are toroidal, said toroidal portions being concentric to said roller axis and extending parallel to one another.

20. The roller as defined in claim 19, wherein said supporting body is continuous and includes a plurality of groups of portions located in successive order, each of said groups including an axial portion extending along said roller axis, a first radial portion extending radially outwardly from said axial portion, one of said toroidal portions extending circumferentially from said radial portion, and a second radial portion extending radially inwardly from said one toroidal portion, said portions of each of said groups being arranged in successive order and connected with one another.

21. The roller as defined in claim 20, wherein said axial portions of said supporting body are formed as axles of the roller.

22. The roller as defined in claim 20, wherein said radial portions of said supporting body are formed as spokes of the roller.

23. The roller as defined in claim 11; and further comprising a central tubular member, said curved tubular member being mounted on said central tubular member.

24. The roller as defined in claim 23, wherein said central tubular member has a further inner passage communicating with said inner passage of said curved tubular member and adapted to accommodate said cooling medium.

25. The roller as defined in claim 23, wherein said central tubular member is thicker than said curved tubular member.

26. The roller as defined in claim 25 wherein said central tubular member has two axially spaced ends; and further comprising bearings, drive means, feed means and return means for said cooling medium, and two cooled pivots located at said axial ends and accommodating said bearings, drive means, feed means and return means.

27. The roller as defined in claim 26; and further comprising substantially cylindrical axial parts each connected with a respective one of said pivots and arranged for extending through an opening in a furnace wall.

28. The roller as defined in claim 27, wherein each of said axial parts is provided with ribs.

29. The roller as defined in claim 27, wherein each of said axial parts has an inner passage, said curved tubular member and said central tubular member having first portions adjacent to said axial parts, said first portions of said curved tubular member and said central tubular member being offset relative to said roller axis and said inner passage of said axial part in radially opposite directions, said central tubular member being detachable from said axial part.

30. The roller as defined in claim 29; and further comprising means for detachably mounting said curved tubular member on said central tubular member.

31. The roller as defined in claim 19; and further comprising a feed pipe, a return pipe, and a further return pipe extending substantially in a direction of said roller axis, said supporting body further including a plurality of spoke portions each having an inner passage and extending substantially radially relative to said roller axis, said spoke portions, said toroidal portions and said pipes so communicating with one another that said cooling medium flows from said feed pipe into said toroidal portions, then into said spoke portions, then into said return pipe, and then returns to a feed side through said further pipe.

32. The roller as defined in claim 31, wherein said pipes has a flow cross-section which is considerably greater than that of said spoke portions and said toroidal portions.

33. The roller as defined in claim 11, wherein said supporting body is helical along at least part of a length thereof.

34. The roller as defined in claim 33, wherein said supporting body consists of a portion which is helical and has two spaced ends, two spoke-like portions extending substantially radially relative to said roler axis and each connected to a respective one of said ends of said helical portion, and two end portions each extending substantially in a direction of said roller axis and connected to a respective one of said spoke-like portions.

35. The roller as defined in claim 33, wherein said helical supporting body has two portions each arranged to be located adjacent to a respective side of a furnace, one of said portions being convoluted in clockwise direction whereas another of said portions being convoluted in counterclockwise direction.

36. The roller as defined in claim 33, wherein said helical supporting body has a plurality of convolutions including with said roller axis an angle which differs in an axial direction.

37. The roller as defined in claim 36, wherein said helical supporting body has two end sections and a central section located therebetween, the convolutions of said central section including with said roller axis an angle which is greater than that included by the convolutions of said end sections with the same.

38. The roller as defined in claim 35, wherein said helical supporting body has two end sections and a central section located therebetween, said helical supporting body having a plurality of convolutions of which the convolutions of said end sections include with said axis an angle which is greater than that included by the convolutions of said central section with the same.

39. The roller as defined in claim 33; and further comprising a central tubular member, and spoke-like members connecting said helical curved tubular member with said central tubular member.

40. The roller as defined in claim 39, wherein said central tubular member is thicker than said curved tubular member.

41. The roller as defined in claim 12, wherein said insulating means includes at least one layer of heat-resistant metal.

42. The roller as defined in claim 41, wherein said heat-resistant metal is a sheet metal.

43. The roller as defined in claim 42, wherein said insulating means includes at least one further such layer interposed with said first-mentioned layer.

44. The roller as defined in claim 12; and further comprising further insulating means located radially inwardly of said first-mentioned insulating means, with respect to said roller axis.

45. The roller as defined in claim 44, wherein said first-mentioned insulating means is formed by a heat-resistant sheet metal, whereas said further insulating means is formed by a layer of a ceramic insulating material.

46. The roller as defined in claim 45, wherein said further inner insulating means includes a plurality of perforated discs having a width which is smaller than the outer diameter thereof, said first-mentioned outer insulating means including a plurality of sections having a length which is twice as great as the outer diameter thereof.

47. The roller as defined in claim 46, wherein each of said discs is constituted partly by a ceramic material having a relatively high density and a relatively high strength, and partly by a ceramic material having a relatively low density and a relatively good insulating characteristics.

48. The roller as defined in claim 47, wherein said material with a relatively low density is a ceramic fiber material.

49. The roller as defined in claim 45, wherein said first-mentioned outer insulating means is formed as a metallic tubular section outwardly surrounding said inner layer of a ceramic insulating material which in turn surrounds said curved tubular member, said metallic tubular section having a continuous cut-out whose width exceeds the diameter of said curved tubular member.

50. The roller as defined in claim 49; and further comprising a cover member closing said cutout of said tubular section and fixedly connected with the latter.

51. The roller as defined in claim 50; and further comprising a pin fixedly connected with said curved tubular member and arranged for preventing axial displacement of said inner layer and said cover member.

52. The roller as defined in claim 50, wherein said inner layer of a ceramic insulating material includes an outer section and an inner section extending in a direction of said center line of said supporting body.

53. The roller as defined in claim 52, wherein said outer section of said inner layer extends through said cutout outwardly beyond said tubular section so as to support a material to be heated in a furnace.

54. The roller as defined in claim 11, particularly for an electric resistance furnace, wherein curved tubular member is constituted by a heat-resistant material and is electrically connected with a source of electric current so as to serve as a heating element.

55. The roller as defined in claim 54, wherein said heat resistant material is molybdenum.

56. The roller as defined in claim 55; and further comprising a central tubular member having cooled pivot elements and carrying said first-mentioned curved tubular member, and current conductors electrically connecting said source with said curved tubular member and extending through said pivot elements.

57. The roller as defined in claim 43, wherein each of said sheet metal layers has an outer surface and an inner surface which are formed as bright surfaces with a low radiation absorption characteristics.

58. The roller as defined in claim 20, wherein each of said toroidal portions merges into said substantially radially extending portions with a radius which is greater than ⅛ of the diameter of the roller.

59. The roller as defined in claim 58; and further comprising an elongated inner curved element and an elongated outer curved element extending in a direction of said central axis and together forming an elongated insulating tubular element outwardly surrounding said curved tubular member and connected to the latter at one point.

60. The roller as defined in claim 59; and further comprising spacers located between said outer tubular element and said curved tubular member so as to maintain a clearance therebetween.

61. The roller as defined in claim 59, wherein said outer tubular element has end portions which have a diameter reduced to the outer diameter of said curved tubular member.

62. The roller as defined in claim 52, wherein said outer and inner sections of said inner layer have surfaces which face toward one another and are provided with means for connecting said sections with one another.

63. The roller as defined in claim 62, wherein said connecting means include loops through which a wire can be pushed.

64. The roller as defined in claim 62, wherein said facing surfaces of said sections bound a gap therebetween; and further comprising refractory mass filling said gap.

65. The roller as defined in claim 11 wherein said curved tubular member has a radially outer surface; and further comprising a projection provided on said radially outer surface and extending in a direction of said center line so as to support a material to be heated.

66. The roller as defined in claim 65; and further comprising means operative for connecting said projection with said curved tubular member and including a weld seam.

67. The roller as defined in claim 66, wherein said weld seam is interrupted.

68. The roller as defined in claim 65, wherein said projection is of one piece with said curved tubular member.

69. The roller as defined in claim 66, wherein said projection has a round cross-section.

70. The roller as defined in claim 66, wherein said projection has a prismatic cross-section.

71. The roller as defined in claim 66; and further comprising a neck portion between said projection and said curved tubular member.

72. The roller as defined in claim 66, wherein said curved tubular member has an inner surface; and further comprising a further such projection arranged on said inner surface of said curved tubular member.

73. The roller as defined in claim 66, wherein said projection is interrupted in the direction of said center line of said curved tubular member.

74. The roller as defined in claim 11; and further comprising a wire arranged at a circumference of said curved tubular member so as to support material to be heated, said wire being not firmly connected to said curved tubular member.

75. The roller as defined in claim 74; and further comprising means for connecting said wire to said tubular member, including a loop fixedly connected to said wire and fitted on said curved tubular member.

76. The roller as defined in claim 74; and further comprising means for connecting said wire with said tubular member and including a loop which is formed by bending said wire and fitted on said curved tubular member.

77. The roller as defined in claim 11; and further comprising a partition wall extending in a direction of said center line of said curved tubular member and subdividing an interior thereof into a closed inner chamber and an open outer chamber, and a rider of a heat resistant material received in said open outer chamber and upwardly projecting therebeyond so as to support a material to be heated.

78. The roller as defined in claim 77, wherein said rider is prismatic.

79. The roller as defined in claim 11; and further comprising two webs arranged on said curved tubular member and bounding a gap therebetween, and a rider of a heat resistant material received in said gap and arranged to support a material to be heated.

80. The roller as defined in claim 79, wherein said curved tubular member is formed as a flattened tube.

81. A roller hearth furnace for heating materials to high temperatures, comprising a housing bounding a chamber; a plurality of rotatable rollers accommodated in said chamber and each having an axis, each of said rollers being formed as a helical supporting body having a plurality of portions surrounding said roller axis and spaced from one another in an axial direction so that a periphery of the roller is materially formed only at locations corresponding to axially spaced locations of said portions and the roller has a plurality of empty regions between said locations, said rollers being identical and are so located relative to one another that a distance between the axes of the two adjacent rollers is smaller than a liameter of each of said rollers; and means for rotating said rollers about said axes so that convolutions of said helical supporting bodies do not come in contact with each other.

* * * * *